US010024083B2

(12) United States Patent
Bejune et al.

(10) Patent No.: US 10,024,083 B2
(45) Date of Patent: Jul. 17, 2018

(54) VEHICLE DOOR LATCH WITH INERTIAL LOCK

(71) Applicant: Ford Global Technologies, LLC, Dearborn, MI (US)

(72) Inventors: Daniel Carl Bejune, Southfield, MI (US); Kosta Papanikolaou, Huntington Woods, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 708 days.

(21) Appl. No.: 14/561,544

(22) Filed: Dec. 5, 2014

(65) Prior Publication Data

US 2016/0160540 A1 Jun. 9, 2016

(51) Int. Cl.

| | |
|---|---|
| ***E05C 3/06*** | (2006.01) |
| ***E05B 77/06*** | (2014.01) |
| *E05C 3/16* | (2006.01) |
| *E05B 85/26* | (2014.01) |

(52) U.S. Cl.

CPC ..... *E05B 77/06* (2013.01); *E05B 85/26* (2013.01)

(58) Field of Classification Search

CPC ..... Y10S 292/22
USPC ..... 292/216, 336.3
See application file for complete search history.

(56) References Cited

U.S. PATENT DOCUMENTS 3,799,596 A * 3/1974 Nozomu ..... E05B 77/06 180/286
3,990,531 A 11/1976 Register
4,536,021 A * 8/1985 Mochida ..... E05B 77/12 292/201
4,988,134 A * 1/1991 Vidwans ..... B60N 2/433 292/198
5,253,906 A * 10/1993 Rogers, Jr. ..... E05B 77/12 292/216
5,427,421 A * 6/1995 Hamaguchi ..... E05B 85/243 292/216
5,531,488 A * 7/1996 Yoshikuwa ..... E05B 63/0065 292/216
5,667,263 A * 9/1997 Kleefeldt ..... E05B 81/06 292/201
5,669,642 A 9/1997 Kang
5,769,471 A * 6/1998 Suzuki ..... E05B 77/12 292/216
5,865,481 A * 2/1999 Buschmann ..... E05B 77/06 292/169.11
5,961,163 A * 10/1999 Brackmann ..... E05B 81/06 292/201
6,007,122 A 12/1999 Linder et al.
(Continued)

FOREIGN PATENT DOCUMENTS

WO 2013093092 A1 6/2013

*Primary Examiner* — Carlos Lugo
(74) *Attorney, Agent, or Firm* — Jason Rogers; Price Heneveld LLP

(57) ABSTRACT

A vehicle door includes a latch mechanism having a fork-bolt that is configured to engage a striker and prevent opening of the vehicle door when the latch mechanism is in a latched configuration. The latch mechanism includes a lock mechanism that disconnects an exterior door handle from the latch mechanism when the latch mechanism is locked. The lock mechanism includes a lock lever having a center of mass that is spaced apart from an axis of rotation of the lock lever whereby the lock lever rotates and locks the latch mechanism in the event of a side impact.

14 Claims, 4 Drawing Sheets

(56) References Cited

U.S. PATENT DOCUMENTS

| | | | | |
|---|---|---|---|---|
| 6,042,159 | A | 3/2000 | Spitzley et al. | |
| 6,241,294 | B1 | 6/2001 | Young et al. | |
| 6,971,688 | B2 | 12/2005 | Drysdale et al. | |
| 7,070,212 | B2 | 7/2006 | Spurr | |
| 7,243,960 | B2 * | 7/2007 | Hoshikawa | E05B 83/36 292/216 |
| 7,293,806 | B2 * | 11/2007 | Umino | E05B 77/54 292/201 |
| 7,481,468 | B2 | 1/2009 | Merideth et al. | |
| 7,635,151 | B2 | 12/2009 | Rodawold, Jr. et al. | |
| 7,686,355 | B2 | 3/2010 | Jankowski et al. | |
| 8,029,032 | B1 | 10/2011 | Yang | |
| 8,038,185 | B2 * | 10/2011 | Wood | E05B 77/06 292/336.3 |
| 8,152,209 | B2 | 4/2012 | Lee | |
| 8,303,004 | B2 | 11/2012 | Lee et al. | |
| 8,322,077 | B2 | 12/2012 | Papanikolaou et al. | |
| 8,366,159 | B2 | 2/2013 | Patel | |
| 8,701,817 | B2 | 4/2014 | Schoen | |
| 8,814,232 | B2 | 8/2014 | Bertolotti | |
| 9,534,424 | B2 * | 1/2017 | Bendel | E05B 77/06 |
| 9,637,953 | B2 * | 5/2017 | Bendel | E05B 77/06 |
| 2005/0184537 | A1 | 8/2005 | Le et al. | |
| 2009/0223263 | A1 | 9/2009 | Puscas et al. | |
| 2010/0320777 | A1 | 12/2010 | Jankowski et al. | |
| 2013/0056999 | A1 | 3/2013 | Beck | |
| 2014/0015263 | A1 | 1/2014 | Da Deppo et al. | |
| 2014/0097624 | A1 | 4/2014 | Papanikolaou et al. | |
| 2014/0132008 | A1 | 5/2014 | Bendel et al. | |
| 2014/0145454 | A1 | 5/2014 | Da Deppo et al. | |

* cited by examiner

VEHICLE DOOR LATCH WITH INERTIAL LOCK

FIELD OF THE INVENTION

The present invention generally relates to door latches for motor vehicles, and in particular to a latch having an inertial lock feature that locks the latch in the event of a side impact.

BACKGROUND OF THE INVENTION

In a typical motor vehicle, a door latch is mounted to a vehicle door. The door latch includes a fork-bolt that engages or grasps a striker mounted on the vehicle body structure. A latch release mechanism includes a releasable pawl member that selectively engages the fork-bolt/latch to prevent disengagement of the fork-bolt from the striker. An exterior handle is mounted on an outer side of the door, and an interior handle is mounted on an inner side of the door. The exterior and interior handles are connected to the latch mechanism utilizing a rod, Bowden cable, interfacing cam surfaces, or other suitable mechanical linkage. The purpose of the door handles is to transfer motion and force from the vehicle operator to the latch release mechanism (e.g. pawl) within the latch to release the fork-bolt/latch from the striker. Once the fork-bolt/latch is released from the striker, the door is free to open.

Vehicle door latch mechanisms typically include a locking mechanism that may be within the latch mechanism. The purpose of the locking mechanism is to mechanically couple or de-couple the handles from the pawl.

When an automobile door latch mechanism is in an unlocked state, the exterior handle is connected to the pawl. When the exterior handle is operated (i.e. manually moved by a user), the pawl is operated, and the fork-bolt/latch releases from the striker, allowing the door to be opened. When the automobile door latch is in the unlocked state, the interior release (typically a movable handle or lever) is mechanically connected to the latch release mechanism. Thus, when the interior handle is operated (moved), the fork-bolt/latch will release from the striker.

When a vehicle door latch mechanism is in the locked state, the exterior handle is mechanically disconnected from the latch release mechanism. When the exterior handle is operated, no motion is transferred to the pawl, and the fork-bolt/latch will not release from the striker. Depending upon the requirements for a particular vehicle, the interior handle may be connected or disconnected from the latch release mechanism when the latch is in the locked stated. Thus, movement of the interior handle will release the fork-bolt/latch from the striker in some vehicles even though the door latch is in a locked state. However, in other vehicles, the interior handle is disconnected when the door latch is in a locked state such that actuation/movement of the interior handle does not cause the fork-bolt/latch to release from the striker.

Vehicle door latch mechanisms can be locked/unlocked in various ways. For example, the vehicle door may include a key cylinder on an exterior of the vehicle that is mechanically connected to the locking mechanism within the latch such that rotation of the key cylinder locks/unlocks the locking mechanism. Vehicle doors may include a moveable lock member such as a lever on an interior side of the door that is mechanically connected to the locking mechanism within the latch. Movement of the interior lock member causes the locking mechanism within the latch to lock/unlock. Vehicles may include an interior and/or exterior power lock control, whereby an electrical or pneumatic actuator operates the lock mechanism inside the latch to thereby lock/unlock the lock mechanism. Powered door locks may be actuated by buttons or the like inside a vehicle, or by a remote fob.

A known type of vehicle door latch mechanism includes a lever internal to the latch that connects (unlock state) or disconnects (lock state) the exterior door handle from the latch release mechanism/pawl. The internal lock lever is directly or indirectly connected to an over-center spring such that the lock lever resides in either the lock or unlock state/position. The lock lever can be moved between the locked and unlocked state/position by operation of a key cylinder on an exterior of the vehicle, operation of a mechanical interior lock member, and/or operating an interior or exterior power lock control button or switch. In known door latch mechanisms, the lock lever only moves between the locked and unlocked positions/states in response to a user input or "request" to change the lock state/position of the lock lever. The user request may comprise actuation of a mechanical lock member, power lock control button/switch inside the vehicle, or actuation of a wireless fob. In this type of door latch system, the lock lever does not normally change state (lock or unlock), if the vehicle is subject to a side impact causing a transverse acceleration to the side.

SUMMARY OF THE INVENTION

One aspect of the present invention is a vehicle door including a door structure having inner and outer sides. The vehicle door includes a latch mechanism including a latch member or fork-bolt that is moveably mounted to the door structure. The fork-bolt is configured to engage a striker on a vehicle structure to retain the vehicle door in a closed position when the fork-bolt is in a latched position. The fork-bolt is moveable to an unlatched position in which the fork-bolt can be disengaged from a striker to permit the vehicle door to be opened. The latch mechanism includes a latch release mechanism such as a pawl that moves between engaged and released positions. The pawl prevents movement of the fork-bolt from its latched position to its unlatched position when the pawl is in its engaged position. The pawl permits movement of the fork-bolt from its latched position to its unlatched position when the pawl is in its released position. The vehicle door includes an outside door handle that is moveably mounted to the outer side of the door structure. The vehicle door includes an outside release lever that is moveable from a rest position to a released position. The outside release lever is operably connected to the outside door handle by a flexible cable, linkage, or the like. Movement of the outside door handle causes the outside release lever to move from its rest position to its released position. The vehicle door includes an inside door handle or release member that is moveably mounted to the door structure. The door further includes a moveable pawl operating lever assembly that is configured to engage the pawl and move the pawl from its engaged position to its released position. An outside intermediate linkage defines a first configuration wherein the outside intermediate linkage interconnects the pawl operating lever assembly to the outside release lever such that movement of the outside release lever causes the pawl operating lever assembly to engage the pawl and move the pawl from its engaged position to its released position. The outside intermediate linkage defines a second configuration wherein movement of the outside release lever does not cause the pawl operating lever assembly to engage the pawl. The latch mechanism includes a lock lever that rotates between an unlocked position and a locked position about an axis. The lock lever causes the outside intermediate linkage to shift from the first configuration to the second configuration upon movement of the lock lever from the unlocked position to the locked position. The lock lever defines a center of mass that is spaced apart from the axis such that acceleration from a side impact causes the lock lever to rotate from the unlocked position to the locked position. When the lock lever is in the locked position, movement of the outside door handle does not cause the pawl to move from its engaged position to its released position.

Another aspect of the present assembly is a latch assembly for vehicle doors. The latch assembly includes a fork-bolt that is moveable between an engaged position and a disengaged position. The fork-bolt is configured to engage (grasp) a striker on a vehicle body structure when the fork-bolt is in the engaged position to retain a vehicle door in a closed position. The latch assembly includes a latch release mechanism having a pawl member that prevents movement of the fork-bolt from the engaged position to the disengaged position when the pawl member engages the fork-bolt. The latch assembly also includes a moveable pawl operating lever assembly that selectively engages the pawl member and disengages the pawl member from the fork-bolt to permit movement of the fork-bolt from its engaged position to its disengaged position. The latch assembly further includes an outside release member, and an internal lock member that rotates about an axis between locked and unlocked positions. Movement of the outside release member causes the pawl operating lever assembly to engage the pawl member and disengage the pawl member from the fork-bolt when the internal lock member is in the unlocked position. When the internal lock member is in the locked position, movement of the outside release member does not cause the pawl operating lever assembly to engage the pawl member such that the fork-bolt remains in the engaged position. The internal lock member defines a center of mass that is offset from the axis about which the internal lock member rotates such that a transverse acceleration due to a side impact on a vehicle door to which the latch assembly is installed causes the internal lock member to rotate from its unlocked position to its locked position. Thus, movement of the outside release member due to the impact does not cause the pawl member to disengage from the fork-bolt.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
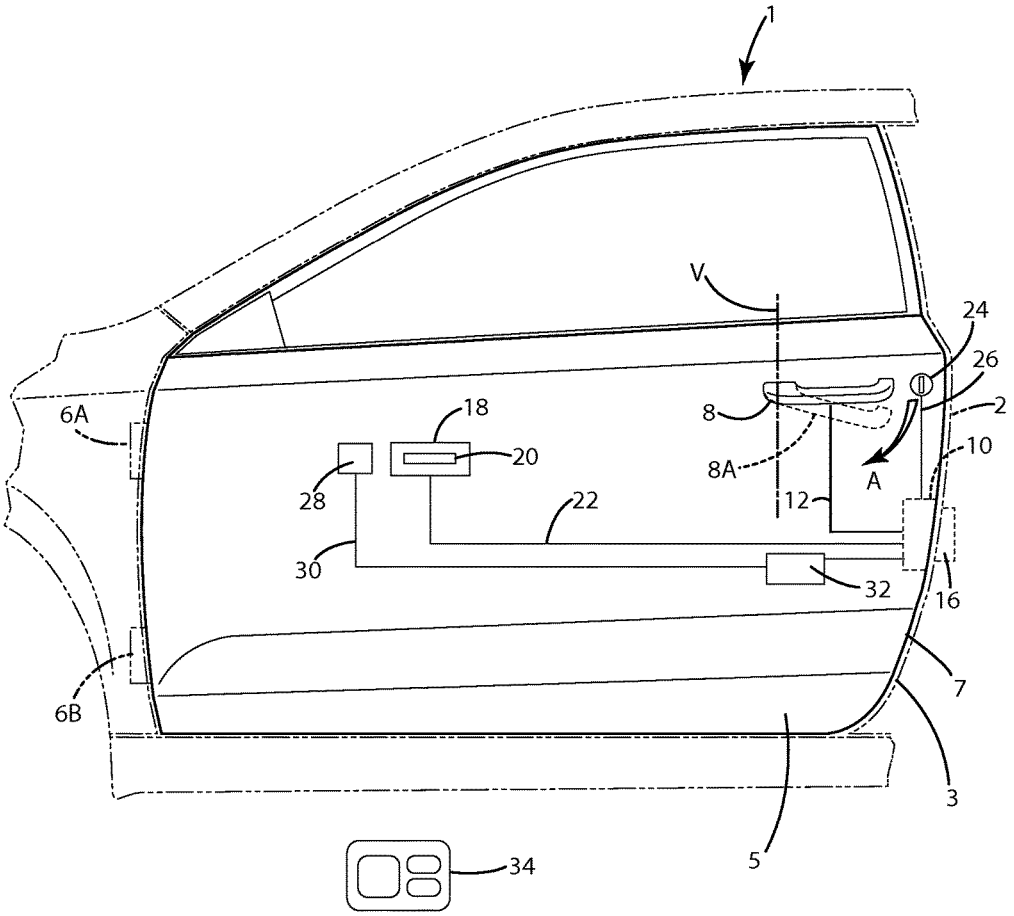
FIG. 1 is a side elevational view of a vehicle door including a door latch according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a motor vehicle 1 includes a body structure 2 forming an opening 3 that is selectively closed off by a door 5. The door 5 is movably mounted to the body structure 2 by hinges 6A and 6B that permit rotation of the door 5 about a vertical axis between open and closed positions in a known manner.

The door 5 includes an exterior door handle 8 that is movably mounted to a door structure 7 for movement between a rest position and an open position. In FIG. 1, the open position is shown in dashed lines and the exterior door handle 8 is designated "8A" in the open position. The exterior door handle 8 is configured to rotate about a generally vertical axis "V" as shown by the arrow "A." However, it will be understood that the present invention is not limited to this specific configuration, and other types of exterior door handles may also be utilized. For example, the door handle 8 may be configured to rotate outwardly and upwardly about a generally horizontal axis.

Exterior door handle 8 is operably connected to a door latch mechanism 10 by linkage 12 such that movement of exterior door handle 8 from the closed position to the actuated position unlatches the door latch mechanism 10, unless the door latch mechanism 10 is in a locked state. When the door latch mechanism 10 is in a locked state, movement of the exterior door handle 8 does not unlatch the door latch mechanism 10. As discussed in more detail below, door latch mechanism 10 includes a latch member or fork-bolt 14 (FIG. 2) that is configured to grasp/engage a striker 16 that is mounted to the body structure 2.

The vehicle door 5 also includes an interior door handle 18 on an inner side of the door 5. The interior door handle 18 may comprise a lever 20 or other suitable moveable member that is connected to the door latch mechanism 10 by a second linkage 22. Second linkage 22 may comprise mechanical links, cables, or the like. Movement of the lever 20 shifts the second linkage 22 to thereby unlatch the door latch mechanism 10 to thereby permit the vehicle door 5 to be opened. Door 5 may also include a lock cylinder 24 that is connected to the door latch mechanism 10 by linkage 26 to lock/unlock the door latch mechanism 10. Door 5 may also include an interior unlock feature 28 disposed on an interior side of the door. The interior unlock feature 28 can be actuated by a user from inside the vehicle 1 to unlock the door latch mechanism 10. Unlock feature 28 may comprise a push button or switch that is operably connected to a powered actuator 32 by an electrical line 30 to thereby provide powered unlocking of door latch mechanism 10. Alternatively, interior unlock feature 28 may comprise a lever or the like that is mechanically connected to the door latch mechanism 10 by a mechanical linkage of a known type to thereby unlock the door latch mechanism 10 upon actuation of the interior unlock feature 28. A remote fob 34 or the like may also be utilized to actuate the powered actuator 32 to unlock the door latch mechanism 10.

Figure 2:
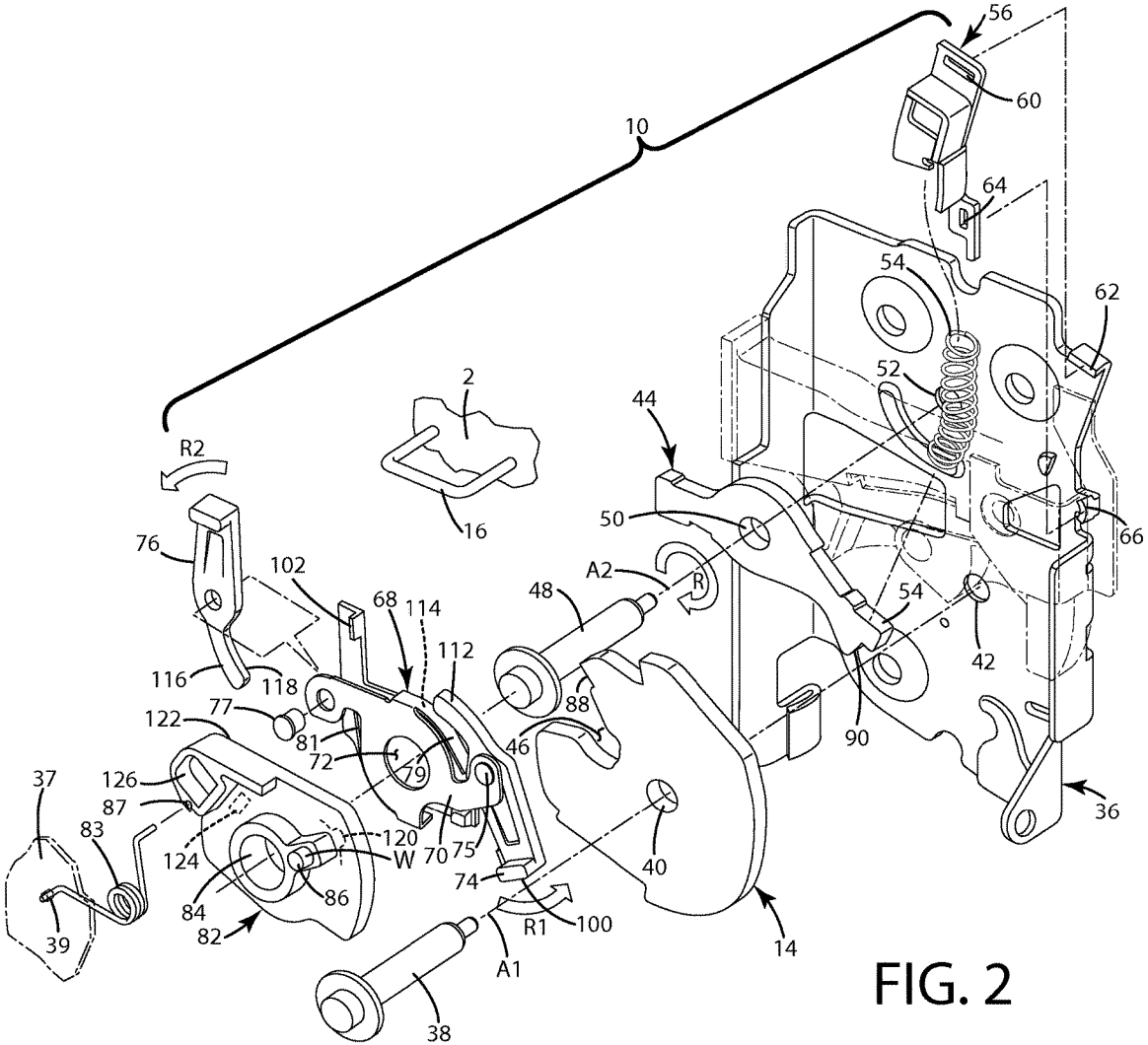
FIG. 2 is an exploded isometric view of a door latch mechanism/assembly according to one aspect of the present invention.

With further reference to FIG. 2, door latch mechanism 10 may include a support structure such as a frame plate or bracket 36 that attaches to the door structure 7. An axle member 38 extends through an opening 40 in fork-bolt 14, and engages opening 42 in bracket 36 to thereby rotatably mount fork-bolt 14 to bracket 36 for rotation about an axis "A1." Axis A1 generally extends in a fore-aft direction in vehicle coordinates. Fork-bolt 14 includes a recessed edge portion 46 that is configured to engage a striker 16 to retain the vehicle door 5 in a closed position. The latch mechanism includes a latch release mechanism such as a pawl 44 that is rotatably mounted to the bracket 36 by a pivot member such as carriage bolt 48. The carriage bolt 48 extends through an opening 50 in pawl 44, and engages an opening 52 in bracket 36 to thereby rotatably mount the pawl 44 on the bracket 36. As discussed in more detail below, the pawl 44 prevents rotation of fork-bolt 14 when pawl 44 is in an engaged position, and permits rotation of fork-bolt 14 when pawl 44 is in a released position. A spring bracket 56 includes first and second slots 60 and 64 that engage first and second tabs 62 and 66, respectively, of frame plate or bracket 36 to thereby connect the spring bracket 56 to the bracket 36. Additional threaded fasteners (not shown) may be utilized to secure spring bracket 56 to bracket 36. A spring 54 is positioned between spring bracket 56 and end 54 of pawl 44 to thereby rotationally bias pawl 44 in the direction "R" about axis "A2." Axis A2 generally extends in a fore-aft direction in vehicle coordinates.

Figure 3:
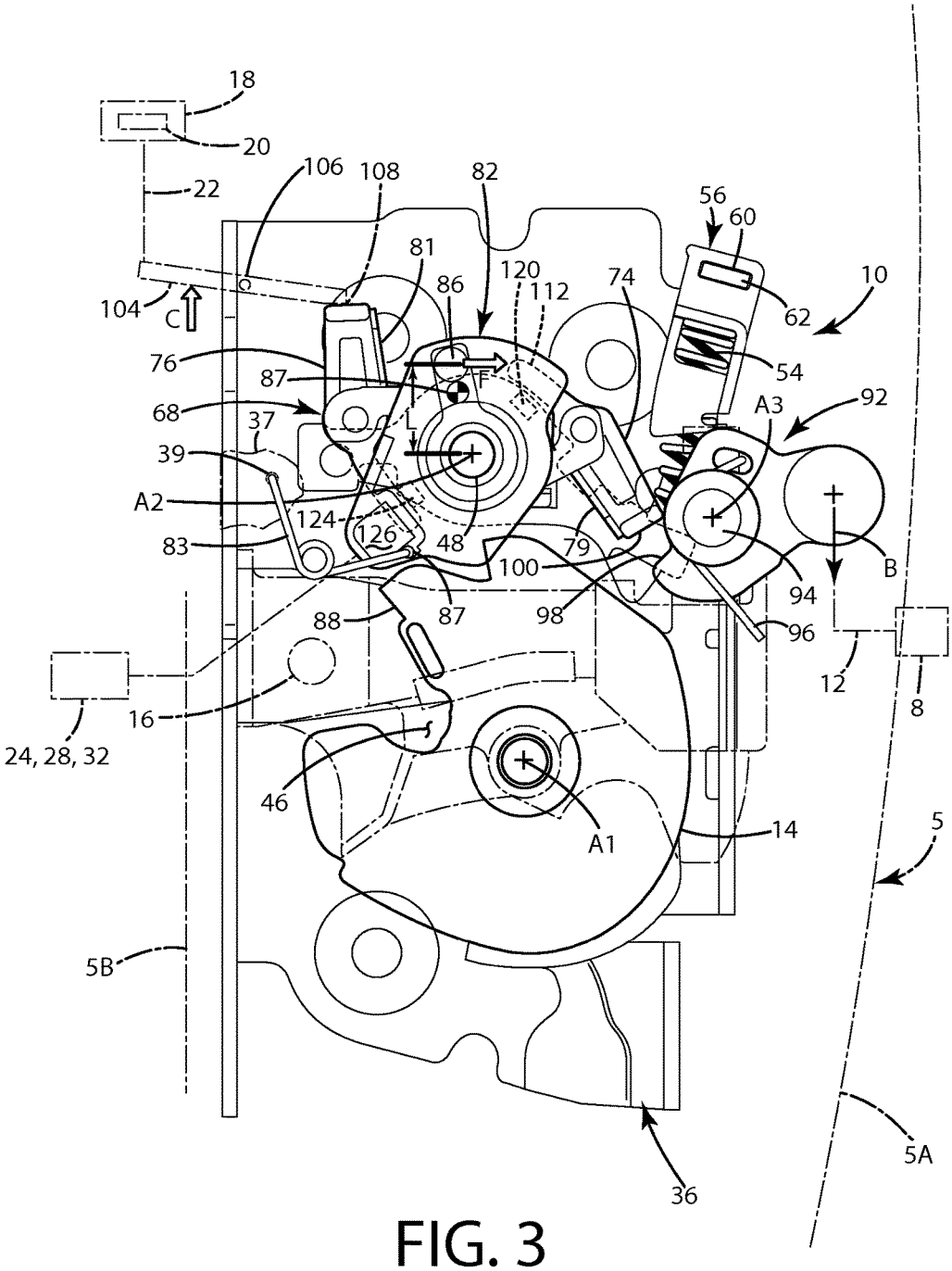
FIG. 3 is a front left side view of the door latch mechanism of FIG. 2 showing the internal lock lever in an unlocked position.
Figure 4:
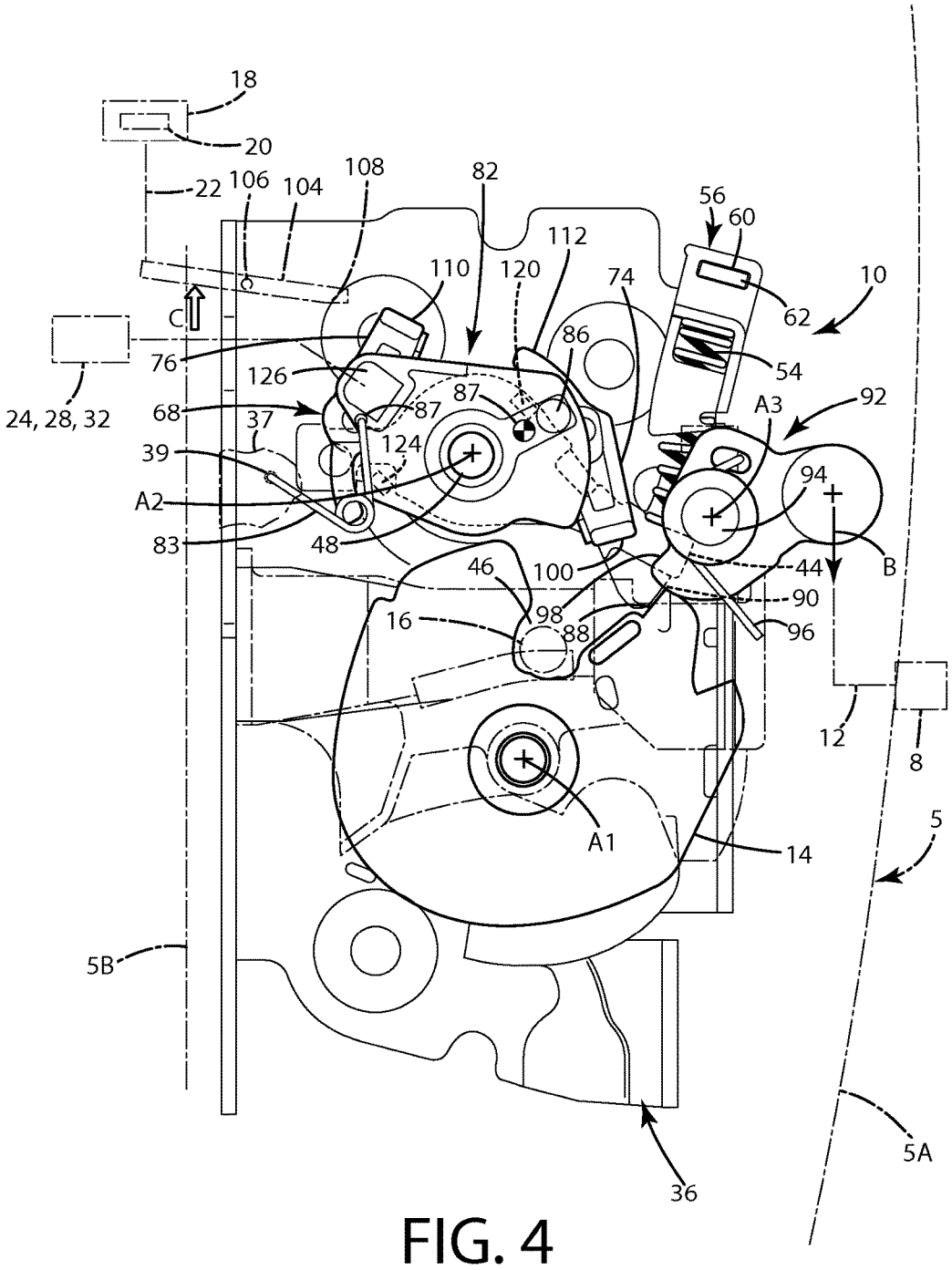
FIG. 4 is a view of the latch mechanism of FIG. 3 showing the internal lock lever in a locked position.

With further reference to FIGS. 3 and 4, when the door latch mechanism 10 is in a latched configuration the striker 16 is received in the recessed edge portion 46 of fork-bolt 14 as shown in FIG. 4. In the latched configuration, end 90 of pawl 44 engages surface 88 of fork-bolt 14 to thereby prevent rotation of the fork-bolt 14 in the counterclockwise direction to the released position of FIG. 3. The spring 54 biases the pawl 44 in the clockwise direction such that the end 90 of pawl 44 remains in engagement with surface 88 of fork-bolt 14, unless a force rotating the pawl 44 against the bias of the spring 54 is applied to the pawl 44. Because the striker 16 is grasped by the recessed edge portion 46 of fork-bolt 14, the striker 16 cannot disengage from the fork-bolt 14 when the pawl 44 is in the engaged position, and the fork-bolt 14 thereby retains the door 5 in the closed position. It will be understood that the basic operation of fork-bolt 14, pawl 44, and striker 16 are well-known in the art.

Referring again to FIG. 2, the door latch mechanism 10 also includes a pawl operating lever assembly 68 including an operating lever 70 having an opening 72 that rotatably supports the operating lever 70 on the axle 48. The pawl operating lever assembly 68 includes an outside intermediate lever or arm 74 that is rotatably connected to the operating lever 70 by a pin 75 or the like. The pawl operating lever assembly 68 also includes an inside intermediate lever or arm 76 that is rotatably connected to the operating lever 70 by a pin 77 or other suitable rotatable connector. The operating lever 70 may be formed from sheet metal or other suitable material. Operating lever 70 includes a first cantilevered spring arm 79 that engages outside intermediate lever 74 and biases the outside intermediate lever 74 for rotation about pin 75 in the direction of the arrow "R1." Operating lever 70 may include a second cantilevered spring arm 81 that engages inside intermediate lever 76 to bias inside intermediate lever 76 for rotation about pin 77 in the direction of the arrow "R2." The configuration of the operating lever 70, outside intermediate lever 74, and inside intermediate lever 76 may be substantially similar to those of known pawl operating lever assemblies.

The door latch mechanism 10 also includes an internal lock lever 82 having an opening 84 that rotatably supports the internal lock lever 82 on axle 84 for rotation about the axis A2. As discussed in more detail below, the internal lock lever 82 rotates between locked and unlocked positions to thereby lock and unlock the door latch mechanism 10. Lock lever 82 may be directly or indirectly connected to an over center spring 83 that engages an opening 39 in a cover/housing 37. Over center spring 83 comprises a known spring whereby the internal lock lever 82 is spring-biased for rotation to the unlocked position (FIG. 3) or to the locked position (FIG. 4) if internal lock lever 82 is in a position between the locked and unlocked positions.

In contrast to known internal lock levers, internal lock lever 82 includes a mass 86 that is offset from the axis of rotation A2. Internal lock lever 82 has a center of mass 87 that is spaced apart from axis A2 such that the internal lock lever 82 rotates from its unlocked position to its locked position when the latch experiences an inward acceleration during a side impact on vehicle 1. It will be understood that a separate mass 86 is not necessarily required to provide a center of mass 87 that is spaced apart from axis A2. For example, internal lock lever 82 may comprise a one piece member that is shaped to provide an offset center of mass 87.

Referring again to FIG. 3, door latch mechanism 10 also includes an outside release lever 92 that is rotatably mounted to bracket 36 by a shaft or pin 94 for rotation about an axis "A3." Axis A3 generally extends in a fore-aft direction in vehicle coordinates. The outside release lever 92 is operably connected to exterior door handle 8 by linkage 12 in a known manner such that movement of exterior door handle 8 rotates the outside release lever 92 in the direction of the arrow "B" about the axis A3. A torsion spring 96 biases the outside release lever 92 in a direction opposite the release direction B. When the internal lock lever 82 is in the position shown in FIG. 3 (i.e. the unlocked position), as outside release lever 92 rotates the surface 98 of outside release lever 92 engages end surface 100 of outside intermediate lever 74. As the outside release lever 92 continues to rotate in a clockwise direction, the outside release lever 92 pushes on outside intermediate lever 74, thereby rotating the operating lever 70 in a counterclockwise direction. Operating lever 70 includes a pawl-engaging surface 102 (FIG. 2) that engages pawl 44 as pawl operating lever 70 rotates, thereby rotating the pawl 44 in a counterclockwise direction (FIG. 3) about axis A2, thereby disengaging end 90 of pawl 44 from surface 88 of fork-bolt 14. When the end 90 of pawl 44 is disengaged from the surface 88 of fork-bolt 14, fork-bolt 14 can rotate in a counterclockwise direction to the unlatched position (FIG. 3), thereby permitting the striker 16 to disengage from fork-bolt 14, such that the vehicle door 5 can be opened. The basic design and operation of outside door handle 8, linkage 12, pawl operating lever 70, and outside release lever 92 may be substantially similar to that of known vehicle doors.

Referring again to FIG. 3, an inside release lever 104 is rotatably mounted to bracket 36 for rotation about a pin 106. The inside release lever 104 is operably connected to inside door handle 18 by linkage 22, such that movement of inside lever 20 of inside door handle 18 causes inside release lever 104 to rotate in a clockwise direction as shown by the arrow "C." When the internal lock lever 82 is in the unlocked position (FIG. 3), as inside release lever 104 rotates, an end 108 of inside release lever 104 engages end 110 of inside intermediate lever 76, thereby generating a force that rotates the pawl operating lever 70 in a counter-clockwise direction, thereby shifting the pawl 44 from the engaged position to the released position to thereby permit rotation of fork-bolt 14 to disengage the fork-bolt 14 from the striker 16. The basic design and operation of the lever 104, inside intermediate lever 76, and pawl operating lever 70 is known in the art.

Referring again to FIG. 3, outside intermediate lever 74 has a curved end portion 112 (see also FIG. 2) having a curved inner surface 114. Similarly, inside intermediate lever 76 has a curved end 116 with an inner surface 118. Internal lock lever 82 includes first and second cams or protrusions 120 and 124 that extend from rear side 122 of internal lock lever 82. The protrusions 120 and 124 engage the inner surfaces 114 and 118, respectively of curved ends 112 and 116 of intermediate levers 74 and 76, respectively. Rotation of internal lock lever 82 relative to the pawl operating lever 70 causes the protrusions 120 and 124 to slide along the inner surfaces 114 and 118, thereby rotating the intermediate levers 74 and 76 about pins 75 and 77, respectively, relative to pawl operating lever 70.

Internal lock lever 82 can be rotated in a clockwise direction from the unlocked position of FIG. 3 to the locked position of FIG. 4. Internal lock lever 82 may be operably interconnected to lock cylinder 24 and/or interior unlock feature 28 and/or powered actuator 32 in a known manner to permit rotation of internal lock lever 82 from the locked position (FIG. 3) to the unlocked position (FIG. 4) as a result of a user input or "request." In this way, a user can lock and unlock door latch mechanism 10.

As the internal lock lever 82 rotates from the unlocked position of FIG. 3 to the locked position of FIG. 4, the protrusions 120 and 124 slide along the curved ends 112 and 116 of levers 74 and 76, thereby rotating the levers 74 and 76 relative to the pawl operating lever 70. As shown in FIG. 4, this causes the end 100 of outside intermediate lever 74 to be rotated inwardly towards axis A2 of internal lock lever 82 such that end 100 is no longer aligned with surface 98 of outside release lever 92. Thus, when the internal lock lever 82 is in the locked position of FIG. 4, movement of outside door handle 8 causes rotation of outside release lever 92, but the pawl operating lever 70 does not move, and the pawl 44 also does not move, such that the end 90 of pawl 44 remains in engagement with surface 88 of fork-bolt 14, thereby preventing rotation of fork-bolt 14 to the released position of FIG. 3.

Rotation of internal lock lever 82 to the locked position of FIG. 4 also causes end 110 of inside intermediate lever 76 to shift inwardly towards axis A2, such that the end 110 of inside intermediate lever 76 does not engage end 108 of inside release lever 104 if inside release lever 104 is rotated as a result of actuation of the lever 20 of interior door handle 18. Thus, when the internal lock lever 82 is in the locked position of FIG. 4, movement of inside lever 20 does not disengage pawl 44 from fork-bolt 14, such that the fork-bolt 14 cannot be rotated, and the door 5 cannot be opened. Alternatively, the internal lock lever 82 and inside intermediate lever 76 can be configured such that movement of inside lever 20 does disengage pawl 44 from fork-bolt 14 to thereby unlatch the door latch mechanism 10 even if the internal lock lever 82 is in the locked position of FIG. 4. For example, the protrusion 124 of internal lock lever 82 and/or the curved end 116 of inside intermediate lever 76 may be eliminated, such that end 108 of inside release lever 104 always engages end 110 of inside intermediate lever 76 upon rotation of inside release lever 104 to thereby rotate operating lever 70 to disengage pawl 44, even if the internal lock lever 82 is in the unlocked position of FIG. 4.

Referring again to FIG. 3, internal lock lever 82 includes a mass 86 that is offset from the axis A2 about which internal lock lever 82 rotates. The center of gravity 87 of internal lock lever 82 is offset from axis A2 a distance "L" due to mass 86, or due to the shape of internal lock lever 82. In the event of a side impact on outer side 5A of door 5, the internal lock lever 82 will be subject to an inward acceleration, resulting in an inertial reaction force "F" acting on the center of gravity 87. Force "F" acts in a horizontal direction towards the outside 5A of vehicle door 5 in a direction that is opposite the external force acting on the outside 5A of vehicle door 5. The force F generates a torque that causes internal lock lever 82 to rotate in a clockwise direction from the unlocked position of FIG. 3 to the locked position of FIG. 4. Thus, due to the mass 86 and resulting offset of center of gravity 87 relative to the axis A2, an impact force on outer side 5A of door 5 will cause the internal lock lever 82 to rotate to the unlocked position (FIG. 4), such that movement of exterior door handle 8 as a result of the impact will not cause pawl 44 to disengage from fork-bolt 14, such that fork-bolt 14 remains in the latched position of FIG. 4. This ensures that the door latch mechanism 10 stays in the latched configuration and the door latch mechanism 10 does not disengage from the striker 16. The center of gravity 87 may be located above axis A2 as shown, or it may be offset below, forward, or rearward of axis A2. In general, virtually any offset of center of gravity 87 relative to axis A2 that results in a moment about axis A2 sufficient to cause internal lock lever 82 to rotate to a locked position if a side impact occurs may be utilized.

The mass 86, internal lock lever 82, and other components are preferably configured such that internal lock lever 82 rotates from its unlocked position to its locked position if a horizontal acceleration of at least 20 g occurs. In general, the moment acting on internal lock lever 82 must be sufficient to overcome the over-center spring 83 and other forces tending to keep the internal lock lever 82 in its unlocked position. However, other design criteria (e.g. at least about 10 g or at least about 30 g) may also be utilized as a minimum "lock" acceleration, and the configurations of the components may be designed to meet other such criteria as may be required.

It is to be understood that variations and modifications can be made on the aforementioned structure without departing from the concepts of the present invention, and further it is to be understood that such concepts are intended to be covered by the following claims unless these claims by their language expressly state otherwise. For example, although the axes A1, A2, and A3 preferably extend in a horizontal fore-aft direction, the present invention is not limited to this specific arrangement, and the axes A1, A2, and/or A3 may be oriented in other directions.

What is claimed is:

1. A vehicle door comprising:

a door structure having inner and outer sides;

a fork-bolt movably mounted to the door structure, wherein the fork-bolt is configured to engage a striker and retain the vehicle door in a closed position when the fork-bolt is in a latched position, and wherein the fork-bolt is movable to an unlatched position in which the fork-bolt can be disengaged from a striker to permit the vehicle door to be opened;

a pawl that moves between engaged and released positions, wherein the pawl prevents movement of the fork-bolt from its latched position to its unlatched position when the pawl is in its engaged position, and wherein the pawl permits movement of the fork-bolt from its latched position to its unlatched position when the pawl is in its released position;

an outside door handle disposed on an outer side of the vehicle door, the outside door handle moving outwardly away from the outer side of the door structure from a closed position to an actuated position when the door is impacted on the outer side;

an outside release lever movable from a rest position to a released position, wherein the outside release lever is operably connected to the outside door handle such that movement of the outside door handle from the closed position to the actuated position causes the outside release lever to move from the rest position to the released position;

a movable pawl operating lever assembly that is configured to engage the pawl and move the pawl from its engaged position to its released position;

the movable pawl operating lever assembly including an outside intermediate linkage defining a first configuration wherein the outside intermediate linkage interconnects the pawl operating lever assembly to the outside release lever such that movement of the outside release lever from the rest position to the released position causes the pawl operating lever assembly to engage the pawl and move the pawl from its engaged position to its released position, the outside intermediate linkage defining a second configuration wherein movement of the outside release lever from the rest position to the released position does not cause the pawl operating lever assembly to engage the pawl; and a lock lever operationally connected to an unlock feature that rotates the lock lever between an unlocked position and a locked position about an axis, wherein the lock lever causes the outside intermediate linkage to shift from the first configuration to the second configuration upon movement of the lock lever from the unlocked position to the locked position, and wherein the lock lever defines a center of mass that is spaced apart from the axis such that acceleration from a side impact causes the outside door handle to move outwardly from the closed position to the actuated position and causes the lock lever to rotate from the unlocked position to the locked position such that the outward movement of the outside door handle from the closed position to the actuated position causes the outside release lever to move from the rest position to the released position but does not cause the pawl to move from its engaged position to its released position such that the pawl remains in the engaged position and prevents movement of the fork-bolt during outward movement of the outside door handle from the closed position to the actuated position.

2. The vehicle door of claim 1, wherein:

the lock lever rotates about a generally horizontal axis that extends in a fore-aft vehicle direction.

3. The vehicle door of claim 2, wherein:

the center of mass of the lock lever is above the horizontal axis when the lock lever is in its unlocked position.

4. The vehicle door of claim 3, wherein:

the movable pawl operating lever assembly comprises a pawl operating lever that is rotatably mounted to the door structure for rotation about a lock axis;

the outside intermediate linkage comprises an outside intermediate lever that is rotatably connected to the pawl operating lever for rotation between a locked configuration and an unlocked configuration relative to the pawl operating lever;

the lock lever rotates about the lock axis and relative to the pawl operating lever and includes a protrusion that engages the outside intermediate lever as the lock lever rotates and moves the outside intermediate lever from the unlocked configuration to the locked configuration, and wherein the outside release lever engages the outside intermediate lever upon rotation of the outside release lever when the outside intermediate release lever is in its unlocked configuration and rotates the pawl operating lever whereby the pawl operating lever engages the pawl and moves the pawl from its engaged position to its released position, and wherein the outside release lever does not engage the outside intermediate lever when the outside intermediate lever is in its locked configuration.

5. The vehicle door of claim 1, wherein:

the pawl is rotatably mounted to the door structure; and including:

a spring biasing the pawl from the released position to the engaged position.

6. The vehicle door of claim 1, including:

an inside latch release member on an inner side of the door whereby a user inside a vehicle can grasp and move the inside latch release member;

an inside intermediate linkage that selectively interconnects the inside latch release member to the pawl operating lever assembly whereby movement of the inside latch release member moves the pawl operating lever assembly and shifts the pawl from its engaged position to its released position.

7. The vehicle door of claim 6, wherein:

the inside intermediate linkage defines a locked configuration wherein the inside intermediate linkage does not interconnect the inside latch release member to the pawl operating lever assembly.

8. A latch assembly for vehicle doors, the latch assembly comprising:

a fork-bolt movable between an engaged position and a disengaged position, and wherein the fork-bolt is configured to grasp a striker on a vehicle body structure when the fork-bolt is in the engaged position to retain a vehicle door in a closed position;

a pawl member that prevents movement of the fork-bolt from the engaged position to the disengaged position when the pawl member engages the fork-bolt;

a movable pawl operating lever assembly that selectively engages the pawl member and disengages the pawl member from the fork-bolt to permit movement of the fork-bolt from its engaged position to its disengaged position;

an outside release member;

an internal lock member operationally connected to an unlock feature that rotates the internal lock lever about an axis between locked and unlocked positions; wherein:

movement of the outside release member causes the pawl operating lever assembly to engage the pawl member and disengage the pawl member from the fork-bolt when the internal lock member is in the unlocked position;

movement of the outside release member does not cause the pawl operating lever assembly to engage the pawl member when the internal lock member is in the locked position, such that the fork-bolt remains in the engaged position;

the internal lock member defines a center of mass that is offset from the axis such that a transverse acceleration due to a side impact on a vehicle door to which the latch assembly is installed causes the internal lock member to rotate from its unlocked position to its locked position such that when the outside release member moves due to the impact the pawl member remains engaged with the fork-bolt and prevents movement of the fork-bolt from the engaged position to the disengaged position.

9. The latch assembly of claim 8, wherein:

the internal lock member rotates about a generally horizontal axis.

10. The latch assembly of claim 9, wherein:

the lock axis extends in a fore-aft vehicle direction.

11. The latch assembly of claim 10, wherein:

the movable pawl operating lever assembly defines a locked configuration and an unlocked configuration; and the internal lock member is operably interconnected to the movable pawl operating lever assembly and shifts the movable pawl operating lever assembly from the locked configuration to the unlocked configuration upon rotation of the internal lock member from the locked position to the unlocked position.

12. The latch assembly of claim 11, wherein:

the movable pawl operating lever assembly rotates about the lock axis.

13. The latch assembly of claim 8, wherein:

a transverse acceleration of at least about 10 g causes the internal lock member to rotate from its unlocked position to its locked position.

14. The latch assembly of claim 8, including:

a powered actuator that rotates the internal lock member from its locked position to its unlocked position.

* * * * *